US007550909B2

(12) United States Patent
True et al.

(10) Patent No.: US 7,550,909 B2
(45) Date of Patent: Jun. 23, 2009

(54) ELECTRON GUN PROVIDING IMPROVED THERMAL ISOLATION

(75) Inventors: Richard Brownell True, Sunnyvale, CA (US); Lucas Kelly Behnke, San Francisco, CA (US); Keith Lee Montgomery, Newark, CA (US)

(73) Assignee: L-3 Communications Corporation, San Carlos, CA (US)

( * ) Notice: Subject to any disclaimer, the term of this patent is extended or adjusted under 35 U.S.C. 154(b) by 470 days.

(21) Appl. No.: 11/531,196

(22) Filed: Sep. 12, 2006

(65) Prior Publication Data

US 2007/0057611 A1 Mar. 15, 2007

Related U.S. Application Data

(60) Provisional application No. 60/716,913, filed on Sep. 13, 2005.

(51) Int. Cl.
*H01J 29/70* (2006.01)

(52) U.S. Cl. ..... 313/440; 313/441; 313/479

(58) Field of Classification Search ..... 313/440, 313/441, 479

See application file for complete search history.

(56) References Cited

U.S. PATENT DOCUMENTS 3,586,901 A * 6/1971 Findeisen ..... 315/14
5,534,747 A 7/1996 Carruthers
5,990,621 A * 11/1999 Sobieradzki ..... 315/5
6,447,355 B1 9/2002 Uda et al.
2003/0015953 A1 1/2003 Taguchi et al.

* cited by examiner

*Primary Examiner*—Vip Patel
(74) *Attorney, Agent, or Firm*—O'Melveny & Myers LLP

(57) ABSTRACT

An electron gun comprises a shell having distal and proximal ends, a cathode structure disposed within the shell and having an electron emitting surface, an anode physically coupled to the shell at the distal end and spaced a fixed distance from the emitting surface, and a plurality of leads adapted to apply a voltage to the cathode structure with respect to the anode sufficient to cause emission of the electrons from the emitting surface. The anode has an aperture for passage therethrough of the beam of electrons emitted by the emitting surface. A first insulator is disposed within the shell proximal to the cathode structure. The first insulator has plural apertures having respective sizes in relation to corresponding ones of the plurality of leads such that the plurality of leads pass therethrough without contacting the first insulator. The first insulator provides stand-off for the voltage between the anode and cathode. A second insulator is disposed with the shell proximal from the first insulator. The second insulator also has plural apertures permitting the plurality of leads to pass therethrough; however, the plurality of leads are tightly engaged within corresponding ones of the plural apertures of the second insulator to provide a vacuum barrier of the shell. A thermal choke is coupled between the first insulator and second insulator to provide an indirect thermal path therebetween.

22 Claims, 4 Drawing Sheets

ELECTRON GUN PROVIDING IMPROVED THERMAL ISOLATION

RELATED APPLICATION DATA

This application claims priority pursuant to 35 U.S.C. § 119(e) to provisional patent application Ser. No. 60/716,913, filed Sep. 13, 2005, the subject matter of which is incorporated by reference herein in its entirety.

BACKGROUND OF THE INVENTION

1. Field of the Invention

The present invention relates to an improved electron gun, and more particularly, to an electron gun having improved thermal characteristics.

2. Description of Related Art

It is well known in the art to utilize a linear electron beam within a traveling wave tube (TWT), klystron, or other microwave device. In a linear beam electron device, an electron beam originating from an electron gun is caused to propagate through a tunnel or a drift tube generally containing an RF interaction structure. At the end of its travel, the electron beam is deposited within a collector or beam dump that effectively captures remaining energy of the spent electron beam. The beam is generally focused by magnetic or electrostatic fields in the interaction structure region of the device in order for it to be effectively transported from the electron gun to the collector without loss to the interaction structure. An RF wave can be made to propagate through a helical structure or set of cavities that comprise the interaction structure, and interact with the electron beam such that the beam gives up energy to the propagating wave. Thus, the electron device may be used as an amplifier for increasing the power of a microwave signal.

The electron gun that provides the electron beam typically comprises a cathode and an anode. The cathode includes an internal heater that raises the temperature of the cathode surface to a level sufficient for thermionic electron emission to occur. When the potential of the anode is sufficiently positive with respect to the cathode, electrons are drawn from the cathode surface and move towards the anode. The geometry of the cathode and anode provide an electrostatic field shape that defines the electron flow pattern. The electronic flow then passes from the electron gun structure through the opening in the anode to the interaction region of the microwave device. Convergent electron guns having spherical cathodes are commonly known as Pierce guns. Electron guns having ring cathodes are commonly known as hollow beam guns.

The typical electron gun is constructed using ceramic structures that provide the functions of mechanically supporting the gun components within a header, electrically isolating the gun components from each other, and providing a wall separating the vacuum environment of the microwave device and the outside world. The ceramic structures often have a cylindrical shape or disk shape. Electrical connections to the gun elements may include metal leads that pass through the ceramic separation structure. These leads may be brazed to the ceramic separation structure in order to form a vacuum seal. Alternatively, the vacuum seal may be provided by metal disks sandwiched with and brazed to the ceramic separation structure. Outside of the vacuum seal, wires may be affixed to the metal leads and the entire region encapsulated by an insulating rubber potting material that prevents high voltage breakdown.

The cathode typically runs at a very high temperature, e.g., around 1,100° Celsius. Some of this heat is conducted through the cathode support structure and the metal leads to the back end of the electron gun header where the leads exit the ceramic separation structure. At this region of the header, the temperature may be approximately 255° C. A drawback with this construction of an electron gun is that the heat can cause the potting material to lose its insulating characteristics (or revert) and thereby allow electrical shorting of the cathode current to the header. This can cause loss of the electron beam and consequent failure of the entire electron beam device. In certain applications requiring high reliability, such as in aerospace or military systems, failure of the electron beam device may render the system inoperative.

Accordingly, it is desirable to provide an electron gun structure having improved thermal isolation to prevent breakdown of the potting material.

SUMMARY OF THE INVENTION

The invention overcomes the drawbacks of the prior art by providing an electron gun having improved thermal characteristics. As known in the art, an electron gun comprises a shell having distal and proximal ends, a cathode structure disposed within the shell and having an electron emitting surface, an anode physically coupled to the shell at the distal end and spaced a fixed distance from the emitting surface, and a plurality of leads adapted to apply a voltage to the cathode structure with respect to the anode sufficient to cause electron emission forming a beam of electrons from the emitting surface. The anode has an aperture for passage therethrough of the beam of electrons emitted by the emitting surface.

More particularly, the electron gun of the present invention provides two separate insulating structures that together serve to reduce thermal transfer from the cathode structure to the proximal end, thereby reducing risk of breakdown of the potting material. A first insulator is disposed within the shell proximal to the cathode structure. The first insulator has plural apertures having respective sizes in relation to corresponding ones of the plurality of leads such that the plurality of leads pass therethrough without contacting the first insulator. The first insulator provides stand-off for the voltage between the anode and cathode. A second insulator is disposed with the shell proximal from the first insulator. The second insulator also has plural apertures permitting the plurality of leads to pass therethrough; however, the plurality of leads are tightly engaged within corresponding ones of the plural apertures of the second insulator to provide a vacuum barrier of the shell. A thermal choke is coupled between the first insulator and second insulator to provide an indirect thermal path therebetween.

A more complete understanding of the electron gun header having improved thermal isolation will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The invention provides an electron gun structure having improved thermal isolation to prevent breakdown of the potting material. In the detailed description that follows, like element numerals are used to describe like elements illustrated in one or more of the figures.

Figure 1:
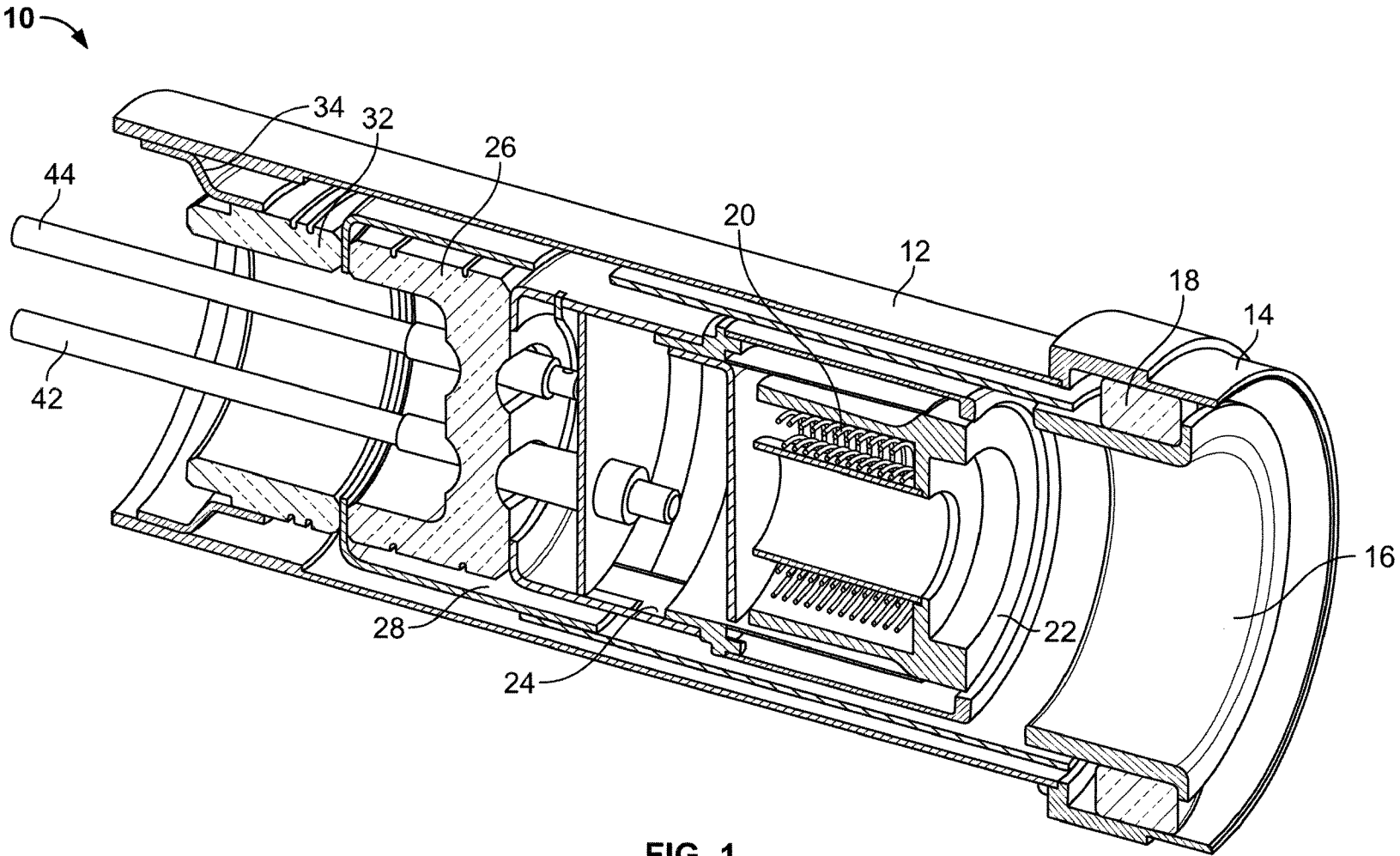
FIG. 1 (Prior Art)
FIG. 1 is a sectional view of an electron gun in accordance with the prior art.

Referring first to FIG. 1, a sectional view of an electron gun 10 is shown in accordance with the prior art. The electron gun 10 includes an outer cylindrical shell 12, also referred to as a header, that substantially contains the electron gun components and facilitates mounting of the electron gun within a larger system, such as a linear beam electron device. The outer shell 12 is generally constructed of metal material. The outer shell 12 includes a flared end 14 having a larger diameter than the shell. An anode ring 16 is disposed concentrically within the flared end 14, and is electrically insulated from the flared end by an insulating ring 18 disposed concentrically between the flared end 14 and the anode ring 16. The insulating ring 18 may be constructed of ceramic material.

A cathode structure is contained within the outer shell 12 such that it is electrically insulated from both the outer shell and from the anode ring 16. The cathode structure has a generally cylindrical shape with a cathode emitting surface 22 oriented at a distal end thereof. The cathode emitting surface 22 is arranged perpendicularly to a central axis of the outer shell 12 and anode ring 16 such that an electron beam emitted from the emitting surface 22 passes through the anode ring. The cathode structure further includes a heater coil 20 that raises the temperature of the emitting surface to an operational level (e.g., around 1,100° C.) sufficient to permit thermionic emission of electrons therefrom. The cathode structure may further include additional focusing electrodes that serve to control the shape of the electric field region between the anode ring 16 and the cathode emitting surface 22, which defines the shape and characteristics of the electron beam that is produced.

The cathode structure is contained within and coupled to a first sleeve 24 that extends proximally from the emitting surface 22. The first sleeve 24 provides mechanical support for the cathode structure to maintain its axial alignment within the outer shell 12. The first sleeve 24 is generally comprised of metal material to provide both electrical and thermal conduction to/from the cathode structure. A proximal end of the first sleeve 24 is squared off to provide an abutting surface that engages a distal end of a first insulator 26. The first insulator 26 has a cylindrical portion and a disk-shaped portion, and is generally comprised of ceramic material to provide electrical isolation and thermal conduction. As discussed above, the first insulator 26 provides the functions of electrically isolating the cathode structure from the anode, forming a vacuum seal between the electron gun and the outside environment, and thermally isolating the distal end of the outer shell 12 from the cathode structure. A second sleeve 28 is disposed concentrically outside the first sleeve 24 and first insulator 26, and extends to the anode ring 16. Like the first sleeve 24, the second sleeve 28 is generally comprised of metal material to provide both electrical and thermal conduction to/from the anode. A proximal end of the second sleeve 28 is squared of to provide an abutting surface that engages a proximal end of the first insulator 26. A second insulator 32 has a cylindrical shape and is aligned with the cylindrical portion of the first insulator 26 such that the abutting surface of the second sleeve 28 is sandwiched between the first and second insulators 26, 32. A third sleeve 34 joins a proximal end of the second insulator 32 to the outer shell 12.

A plurality of electrically conductive leads enter the electron gun from the proximal end to provide electrical connections to the components of the electron gun. A first lead 42 provides an electrical connection to the cathode heater (not shown) in the chamber behind the cathode emitting surface 22. A second lead 44 provides an electrical connection to the cathode emitting surface 22 through the first sleeve 24. A third lead (not shown) provides an electrical connection to the anode ring 16 through the second sleeve 28. The conductive leads are generally constructed of electrically conductive materials, such as metal. The conductive leads pass through respective feed-through openings formed in the first insulator 26. In order to form an vacuum seal within the electron gun, the conductive leads are brazed to the ceramic material of the first insulator 26. Lastly, the space within the first and second insulators 26, 32 through which the conductive leads pass may be further filled with a rubberized potting material in order to prevent arcing between the conductive leads and from the conductive leads to the second or third sleeves.

With operational voltages applied to the electron gun components through the conductive leads, it should be appreciated that the first insulator 26 will stand off the high voltage (e.g., around 10 kilovolts) between the cathode emitting surface 22 and the anode ring 16. At the same time, the first insulator 26 becomes very hot due to thermal conduction from the cathode structure through the first sleeve 24. As discussed above, the heat at this proximal region of the electron gun may cause the potting material to revert, resulting in failure of the electron gun.

Figure 2:
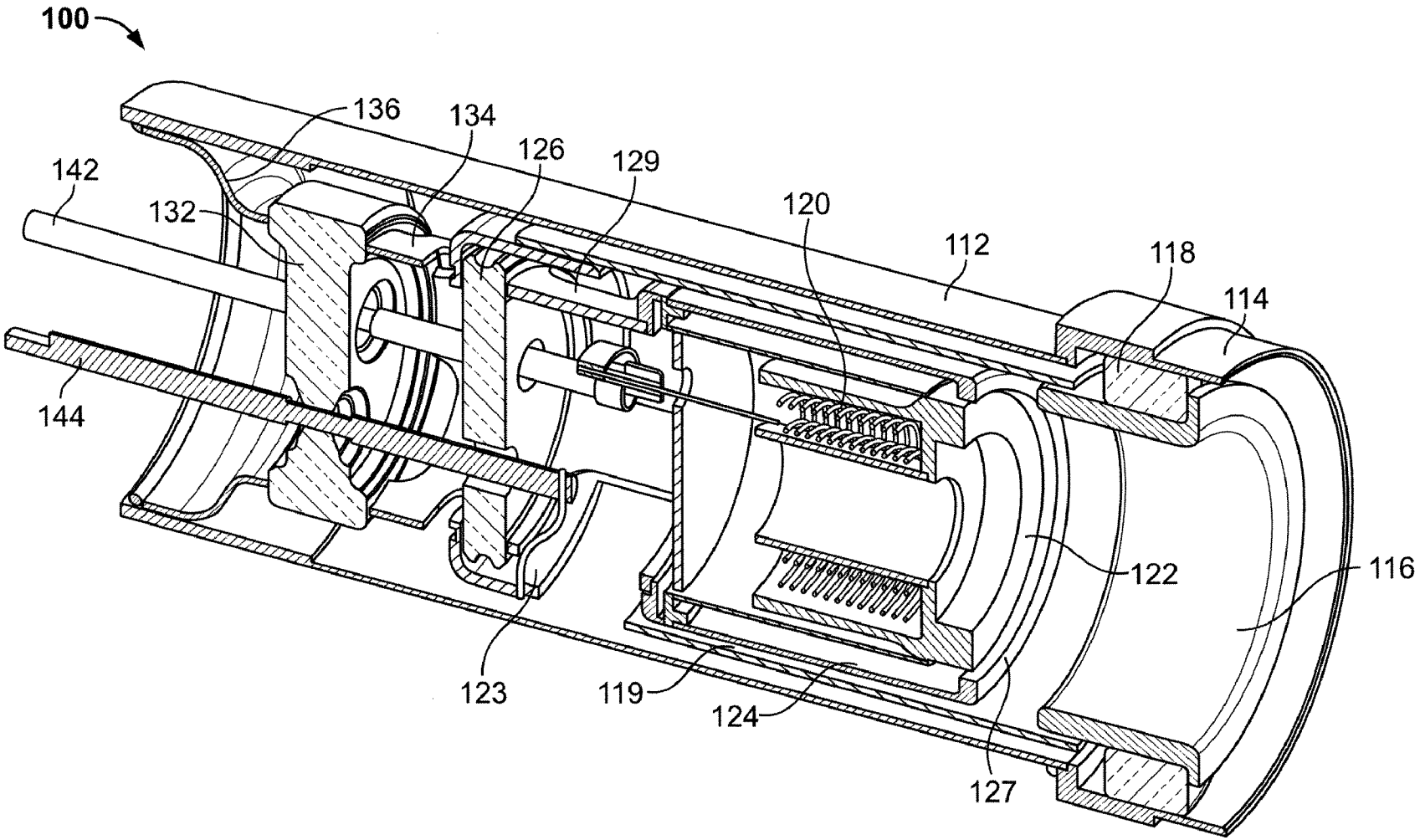
FIG. 2 is a sectional view of an electron gun in accordance with an embodiment of the invention.

The present invention overcomes this drawback of the prior art by providing an electron gun having improved thermal characteristics. Referring now to FIG. 2, a sectional view of an exemplary electron gun 100 is shown in accordance with an embodiment of the invention. As with the prior art device, the electron gun 100 includes an outer cylindrical shell 112 having a flared end 114. An anode ring 116 is disposed concentrically within the flared end 114, and is electrically insulated from the flared end by an insulating ring 118 disposed concentrically between the flared end 114 and the anode ring 116.

A cathode structure is contained within the outer shell 112 such that it is electrically insulated from both the outer shell and from the anode ring 116. The cathode structure has a generally cylindrical shape with a cathode emitting surface 122 oriented at a distal end thereof. The cathode emitting surface 122 is arranged perpendicularly to a central axis of the outer shell 112 and anode ring 116 such that an electron beam emitted from the emitting surface 122 passes through the anode ring. The cathode structure further includes a heater coil 120 disposed in a cavity provided below the emitting surface 122. The heater coil 120 may be held in place within the cavity by use of a ceramic potting material or may be freestanding as is shown in FIG. 2. The cathode structure of FIG. 2 further includes a focusing electrode 127 surrounding the emitting surface 122. It should be appreciated that other arrangements of the emitting surface 122, anode ring 116 and/or focusing electrodes could be advantageously utilized depending on the desired performance requirements of the electron gun.

Figure 3:
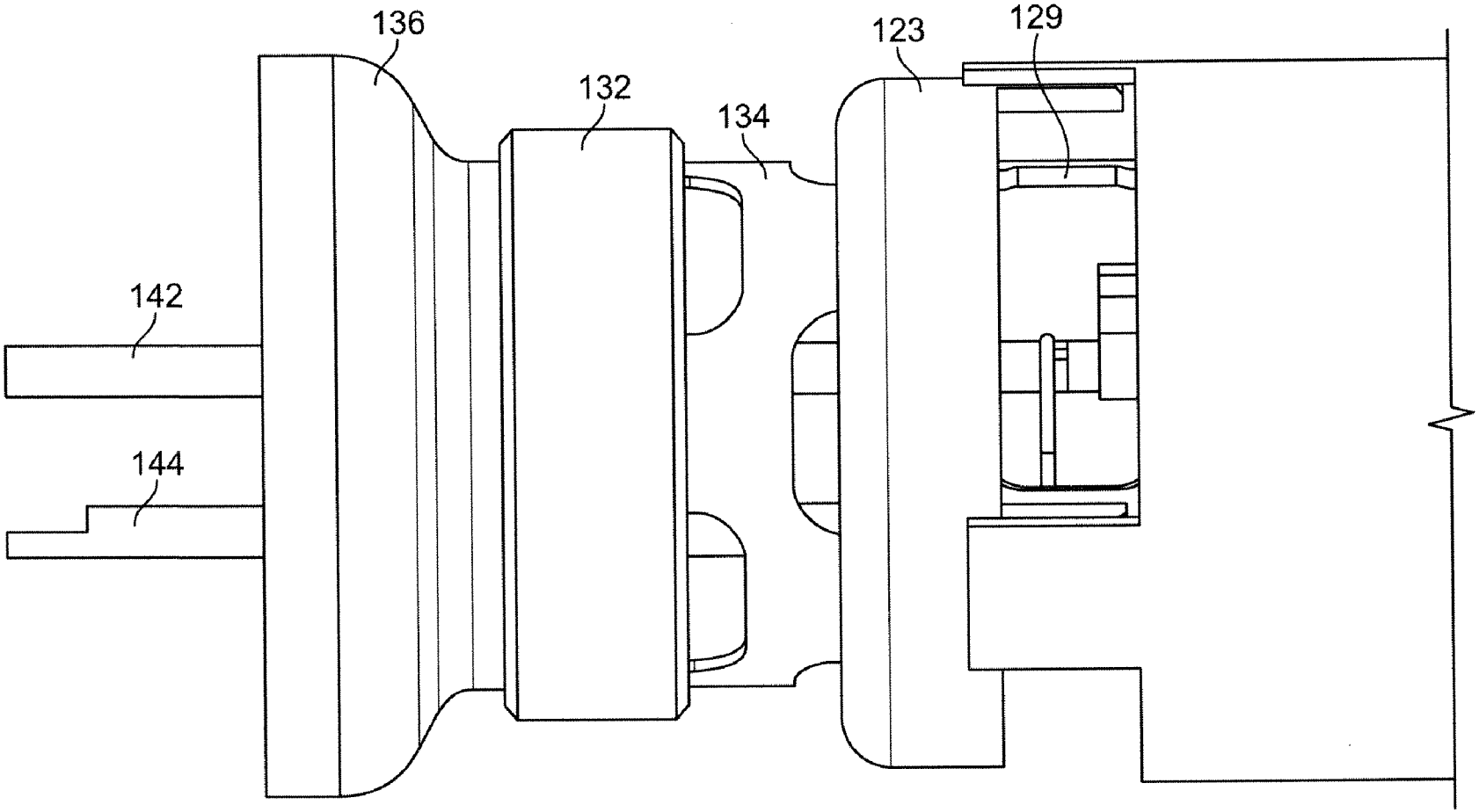
FIG. 3 is a side view of a portion of the exemplary electron gun of FIG. 2.

The cathode structure includes an outer body 124 that is electrically connected to the emitting surface 122. The outer body 124 is mechanically coupled to a first insulator 126 through a plurality of spacers 129. The first insulator 126 has a disk-shape and is generally comprised of ceramic material to provide electrical isolation. The spacers 129 do not correspond to the entire circumference of the outer body 124, but rather are spaced from one another in order to minimize thermal coupling between the cathode structure and the first insulator 126. A sleeve 119 provides mechanical support for the anode structure and is generally comprised of metal material to provide electrical conduction with the anode ring 116. A central portion of the sleeve 119 proximal of the cathode structure is discontinuous rather than having material throughout the entire circumference of the sleeve. As shown in FIGS. 2 and 3, this central portion of the sleeve 119 comprises a plurality of narrow bands 123 spanning between proximal and distal portions of the sleeve. The exemplary embodiment of FIGS. 2 and 3 include three such bands 123, though it should be appreciated that a different number could be chosen. As with the spacers 129 discussed above, the reduction of material of the sleeve 119 in this central portion reduces the thermal coupling to the anode ring 116. An end of the bands 123 is squared off to provide an abutting surface that engages a side of first insulator 126 opposite from the side engaged by the spacers 129.

A second insulator 132 is disposed proximal from the first insulator 126, and is coupled to the first insulator 126 by a choke sleeve 134. Like the first insulator 126, the second insulator 132 has a disk-shape and is generally comprised of ceramic material to provide electrical isolation. The choke sleeve 134 is comprised of metal material and has oval-shaped regions removed from the distal and proximal end edges thereof. The removed regions are offset from one another, such that a direct axial path is not provided between the respective distal and proximal ends. As with the other features described above, the construction of the choke sleeve 134 serves to reduce thermal coupling between the first and second insulators 126, 132. An end sleeve 136 joins the second insulator 132 to the outer shell 112.

As in the prior art device, a plurality of electrically conductive leads enter the electron gun from the proximal end to provide electrical connections to the components of the electron gun. A first lead 142 provides an electrical connection to the cathode heater 120. A second lead 144 provides an electrical connection to the anode ring 116 through the bands 123 and sleeve 119. A third lead (not shown) provides an electrical connection to the cathode emitting surface 122 through the spacers 129 and outer body 124. The conductive leads are generally constructed of electrically conductive materials, such as metal. The conductive leads pass through respective feed-through openings formed in the first and second insulators 126, 132. In order to form an vacuum seal within the electron gun, the conductive leads are brazed to the ceramic material of the second insulator 132. But, the feed-throughs of the first insulator 126 are sized to be larger than the conductive leads so that the conductive leads pass therethrough without physically contacting the first insulator 126. This way, thermal coupling between the first and second insulators 126, 132 through the conductive leads is minimized. The space within the second insulator 132 through which the conductive leads pass may be further filled with a rubberized potting material in order to prevent arcing between the conductive leads.

Hence, the first insulator 126 provides most of the thermal insulation from the cathode structure and the second insulator 132 provides the vacuum seal with the external environment and some additional thermal insulation. The first insulator 126 will also stand-off the high voltage (e.g., around 10 kilovolts) between the cathode emitting surface 122 and the anode ring 116. Much less heat is conducted to the second insulator in view of the restricted thermal path provided by the choke sleeve 134, spacers 129 and bands 123.

Figure 4:
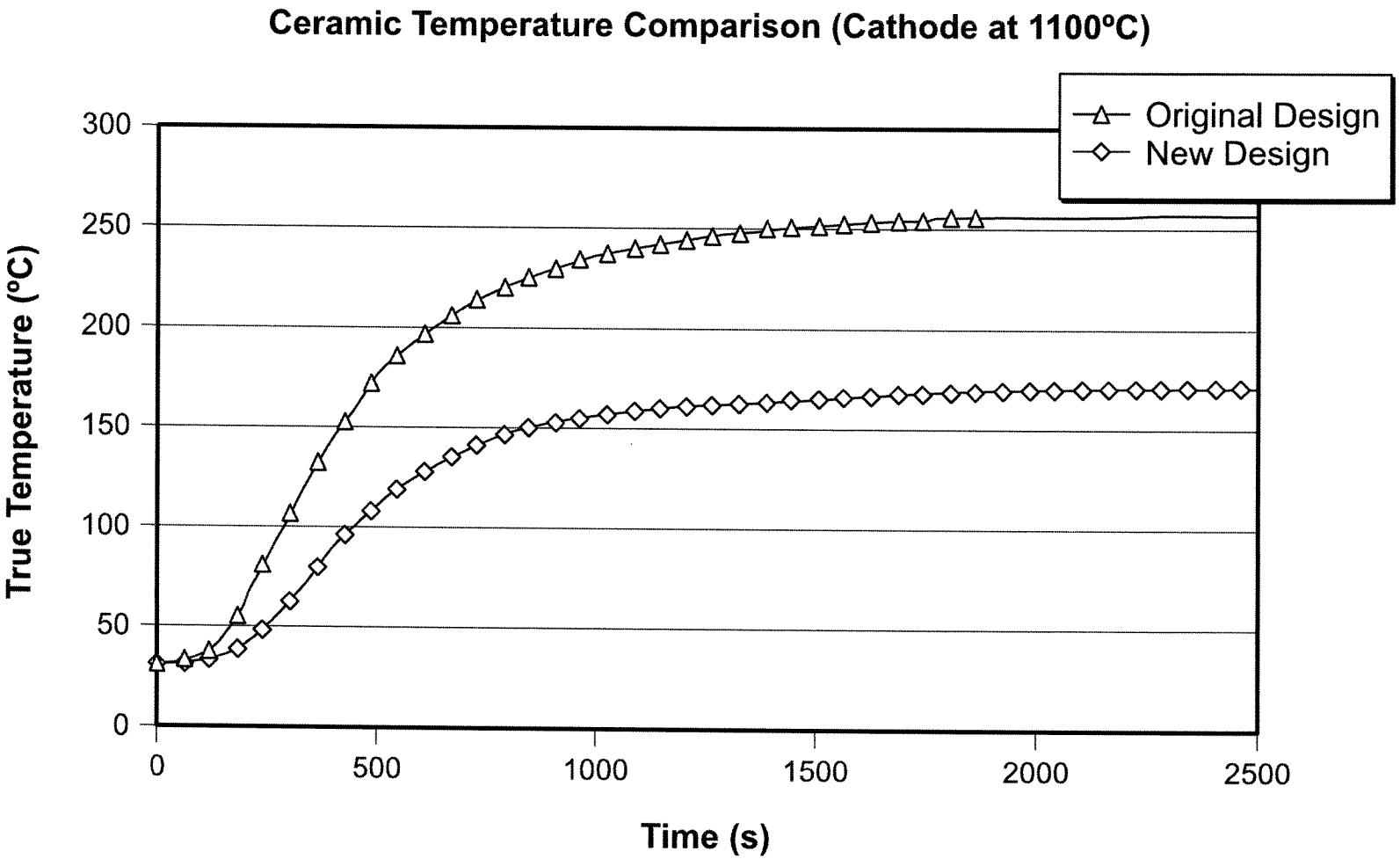
FIG. 4 is a graph comparing thermal performance of the prior art electron gun with that of the embodiment of the present invention.

FIG. 4 provides a chart comparing the thermal performance of the prior art electron gun of FIG. 1 (graphically denoted by triangles) with an exemplary electron gun constructed in accordance with the embodiment of FIGS. 2 and 3 (graphically denoted by diamonds). The vertical axis of the graph shows the temperature measured at the proximal end of the electron gun, and the horizontal axis shows a time scale measured in seconds. For each device, the temperature rises quickly after start-up and levels off at a steady-state temperatures after roughly 1000 seconds. The graph reflects an approximate 85° C. difference between the prior art device and the exemplary electron gun. This temperature difference is sufficient to maintain the potting material at a sustainable temperature and avoid a breakdown condition, thereby resulting in substantially improved device reliability.

It should be appreciated that the thermal isolation characteristics of the present invention could be applied to various other types of electron guns, such as conventional diode or gridded Pierce electron guns. Other alternative embodiments of the separated ceramic insulators may provide similar advantages. For example, the first insulator may take the form of blocks brazed to the outer shell. In another example, the first insulator may be provided with small feet for positioning the cathode structure within the outer shell. These exemplary embodiments can potentially provide further advantages in terms of axial alignment of the cathode structure.

Having thus described a preferred embodiment of an electron gun structure having improved thermal characteristics, it should be apparent to those skilled in the art that certain advantages of the described apparatus have been achieved. It should also be appreciated that various modifications, adaptations, and alternative embodiments thereof may be made within the scope and spirit of the present invention. The invention is defined solely by the following claims.

What is claimed is:

1. An electron gun comprising:

a shell having distal and proximal ends;

a cathode structure disposed within the shell and having an electron emitting surface;

an anode physically coupled to the shell at the distal end and spaced a fixed distance from the emitting surface, the anode having an aperture for passage therethrough of a beam of electrons emitted by the emitting surface;

a plurality of leads adapted to apply a voltage to the cathode structure with respect to the anode sufficient to cause emission of the beam from the emitting surface;

a first insulator disposed within the shell proximal to the cathode structure, the first insulator having plural apertures having respective sizes in relation to corresponding ones of the plurality of leads such that the plurality of leads pass therethrough without contacting the first insulator, the first insulator providing stand-off for the voltage;

a second insulator disposed with the shell proximal from the first insulator, the second insulator having plural apertures permitting the plurality of leads to pass therethrough, the plurality of leads being tightly engaged within corresponding ones of the plural apertures of the second insulator to provide a vacuum barrier of the shell; and a thermal choke coupled between the first insulator and second insulator to provide an indirect thermal path therebetween.

2. The electron gun of claim 1, wherein the thermal choke comprises a cylindrical structure having plural regions removed from each respective end, the plural regions of each such end being substantially offset from one another.

3. The electron gun of claim 1, wherein the first insulator comprises a disk shape.

4. The electron gun of claim 3, wherein the second insulator comprises a disk shape.

5. The electron gun of claim 1, wherein one of the plurality of leads is electrically coupled to the cathode structure through a plurality of conductive spacers.

6. The electron gun of claim 1, wherein the cathode structure further comprises a heater, and one of the plurality of leads is electrically coupled to the heater.

7. The electron gun of claim 1, wherein one of the plurality of leads is electrically coupled to the anode through a corresponding sleeve having a discontinuous portion comprising a plurality of bands.

8. The electron gun of claim 1, wherein the shell has a cylindrical shape.

9. The electron gun of claim 1, wherein the first and second insulators are comprised of ceramic material.

10. The electron gun of claim 1, wherein the cathode structure comprises at least one focusing electrode.

11. The electron gun of claim 1, wherein the thermal choke comprises a metal material.

12. The electron gun of claim 1, further comprising potting material disposed within a proximal region of the shell bounded by the second insulator.

13. An electron gun comprising:

a shell having distal and proximal ends;

a cathode structure disposed within the shell and having an electron emitting surface;

an anode physically coupled to the shell at the distal end and spaced a fixed distance from said emitting surface, the anode having an aperture for passage therethrough of a beam of electrons emitted by the emitting surface;

a plurality of leads adapted to apply a voltage to the cathode structure with respect to the anode sufficient to cause emission of the beam from the emitting surface;

first means for insulating the cathode structure, the first insulating means providing passage of the plurality of leads therethrough without physical contact, the first insulating means further providing stand-off for the voltage;

second means for insulating the cathode structure spaced from the first insulating means, the second insulating means providing passage of the plurality of leads therethrough while providing a vacuum barrier of the shell; and means for coupling the first and second insulating means together to provide an indirect thermal path therebetween.

14. The electron gun of claim 13, wherein the coupling means comprises a cylindrical structure having plural regions removed from each respective end, the plural regions of each such end being substantially offset from one another.

15. The electron gun of claim 13, wherein the first insulating means comprises a first ceramic disk.

16. The electron gun of claim 15, wherein the second insulating means comprises a second ceramic disk.

17. The electron gun of claim 13, wherein one of the plurality of leads is electrically coupled to the cathode structure through a plurality of spaced conductors.

18. The electron gun of claim 13, wherein the cathode structure further comprises a heater, and one of the plurality of leads is electrically coupled to the heater.

19. The electron gun of claim 13, wherein one of the plurality of leads is electrically coupled to the anode through a corresponding sleeve having a discontinuous portion comprising a plurality of bands.

20. The electron gun of claim 13, wherein the shell has a cylindrical shape.

21. The electron gun of claim 13, wherein the cathode structure comprises at least one focusing electrode.

22. The electron gun of claim 13, further comprising potting material disposed within a proximal region of the shell bounded by the second insulating means.

* * * * *